US008381702B2

(12) United States Patent
Vogler

(10) Patent No.: US 8,381,702 B2
(45) Date of Patent: Feb. 26, 2013

(54) LOAD ADJUSTING DEVICE

(75) Inventor: Hans-Ulrich Vogler, Frankfurt (DE)

(73) Assignee: Continental Automotive GmbH, Hannover (DE)

( * ) Notice: Subject to any disclaimer, the term of this patent is extended or adjusted under 35 U.S.C. 154(b) by 494 days.

(21) Appl. No.: 12/602,336

(22) PCT Filed: May 7, 2008

(86) PCT No.: PCT/EP2008/055603
§ 371 (c)(1),
(2), (4) Date: Dec. 22, 2009

(87) PCT Pub. No.: WO2008/145492
PCT Pub. Date: Dec. 4, 2008

(65) Prior Publication Data

US 2010/0212626 A1 Aug. 26, 2010

(30) Foreign Application Priority Data

May 31, 2007 (DE) ..... 10 2007 025 441

(51) Int. Cl.
*F02D 9/08* (2006.01)
*F02D 41/00* (2006.01)

(52) U.S. Cl. ..... 123/337; 123/361; 123/198 D

(58) Field of Classification Search ..... 123/337, 123/361, 198 F, 198 D, 198 DB
See application file for complete search history.

(56) References Cited

U.S. PATENT DOCUMENTS

| | | | | |
|---|---|---|---|---|
| 4,212,272 | A * | 7/1980 | Hawk | 123/339.25 |
| 4,947,815 | A | 8/1990 | Peter | |
| 5,016,586 | A * | 5/1991 | Imamura et al. | 123/336 |
| 5,121,727 | A * | 6/1992 | Kramer et al. | 123/399 |
| 5,168,951 | A * | 12/1992 | Sugiura et al. | 180/197 |
| 5,778,853 | A * | 7/1998 | Saito | 123/396 |
| 6,164,623 | A * | 12/2000 | Ito et al. | 251/305 |
| 6,347,613 | B1 * | 2/2002 | Rauch | 123/337 |
| 6,371,080 | B1 * | 4/2002 | Saito et al. | 123/337 |
| 6,382,181 | B2 * | 5/2002 | Wayama et al. | 123/399 |
| 6,386,178 | B1 * | 5/2002 | Rauch | 123/337 |
| 6,390,062 | B1 * | 5/2002 | Saito et al. | 123/399 |
| 6,488,010 | B2 * | 12/2002 | Saito et al. | 123/399 |
| 6,502,542 | B1 | 1/2003 | Stuart | |
| 6,591,809 | B2 * | 7/2003 | Saito et al. | 123/399 |

(Continued)

FOREIGN PATENT DOCUMENTS

| | | |
|---|---|---|
| DE | 1 023 268 | 1/1958 |
| DE | 36 31 283 A1 | 3/1988 |

(Continued)

*Primary Examiner* — Stephen K Cronin
*Assistant Examiner* — Raza Najmuddin
(74) *Attorney, Agent, or Firm* — Cozen O'Connor

(57) ABSTRACT

A load adjustment device for an actuator that determines the power of an internal combustion engine, designed as a throttle valve and is disposed on an actuator shaft in a housing, the actuator shaft being pivotally drivable about the rotary axis of the actuator shaft between a minimal load setting defined by a minimal load stop and a full load setting defined by a full load stop by means of a reversibly drivable actuating drive via an actuating part rotationally fixed to said shaft. The actuator shaft is subject to a load in the minimum load direction by a restoring spring. The actuating part can be subjected to a load by a leg of a torsion spring disposed radially outside the pivoting range of the part, the leg of the torsion spring extending into the pivoting range of the actuating part.

16 Claims, 1 Drawing Sheet

U.S. PATENT DOCUMENTS

| | | | | |
|---|---|---|---|---|
| 6,672,280 | B2 * | 1/2004 | Price et al. | 123/337 |
| 6,691,681 | B2 * | 2/2004 | Wayama et al. | 123/399 |
| 6,880,522 | B2 * | 4/2005 | Kino et al. | 123/337 |
| 6,892,698 | B2 * | 5/2005 | Kino et al. | 123/337 |
| 6,945,228 | B2 * | 9/2005 | Saito et al. | 123/399 |
| 6,966,297 | B2 * | 11/2005 | Wayama et al. | 123/399 |
| 6,973,913 | B2 | 12/2005 | Knorpp et al. | |
| 6,997,438 | B2 * | 2/2006 | Fauni | 251/305 |
| 7,121,259 | B2 * | 10/2006 | Wayama et al. | 123/399 |
| 7,237,529 | B2 | 7/2007 | Hannewald et al. | |
| 7,536,993 | B2 * | 5/2009 | Tsukiji et al. | 123/399 |
| 2001/0045202 | A1 * | 11/2001 | Shimura et al. | 123/399 |
| 2002/0033166 | A1 * | 3/2002 | Shimura et al. | 123/399 |
| 2003/0145827 | A1 * | 8/2003 | Klug et al. | 123/396 |
| 2004/0123835 | A1 * | 7/2004 | Kawai et al. | 123/337 |
| 2006/0236971 | A1 | 10/2006 | Kanda et al. | |
| 2007/0170391 | A1 * | 7/2007 | Liimatta et al. | 251/306 |
| 2008/0011269 | A1 * | 1/2008 | Tanimura et al. | 123/337 |
| 2009/0101104 | A1 * | 4/2009 | Baasch et al. | 123/337 |
| 2009/0266334 | A1 * | 10/2009 | Kasai et al. | 123/337 |
| 2011/0056460 | A1 * | 3/2011 | Kondo et al. | 123/337 |
| 2011/0120414 | A1 * | 5/2011 | Quantz | 123/337 |

FOREIGN PATENT DOCUMENTS

| | | | |
|---|---|---|---|
| DE | 39 18 853 | A1 | 12/1990 |
| DE | 4039937 | | 6/1992 |
| DE | 197 21 239 | A1 | 12/1998 |
| DE | 102 02 096 | A1 | 7/2003 |
| DE | 102 30 199 | A1 | 1/2004 |
| DE | 103 27 045 | A1 | 4/2005 |
| DE | 10 2004 016 912 | A1 | 11/2005 |
| DE | 10 2005 029 262 | A1 | 1/2007 |
| DE | 10 2005 052 362 | A1 | 5/2007 |
| JP | 59196936 | | 11/1984 |

* cited by examiner

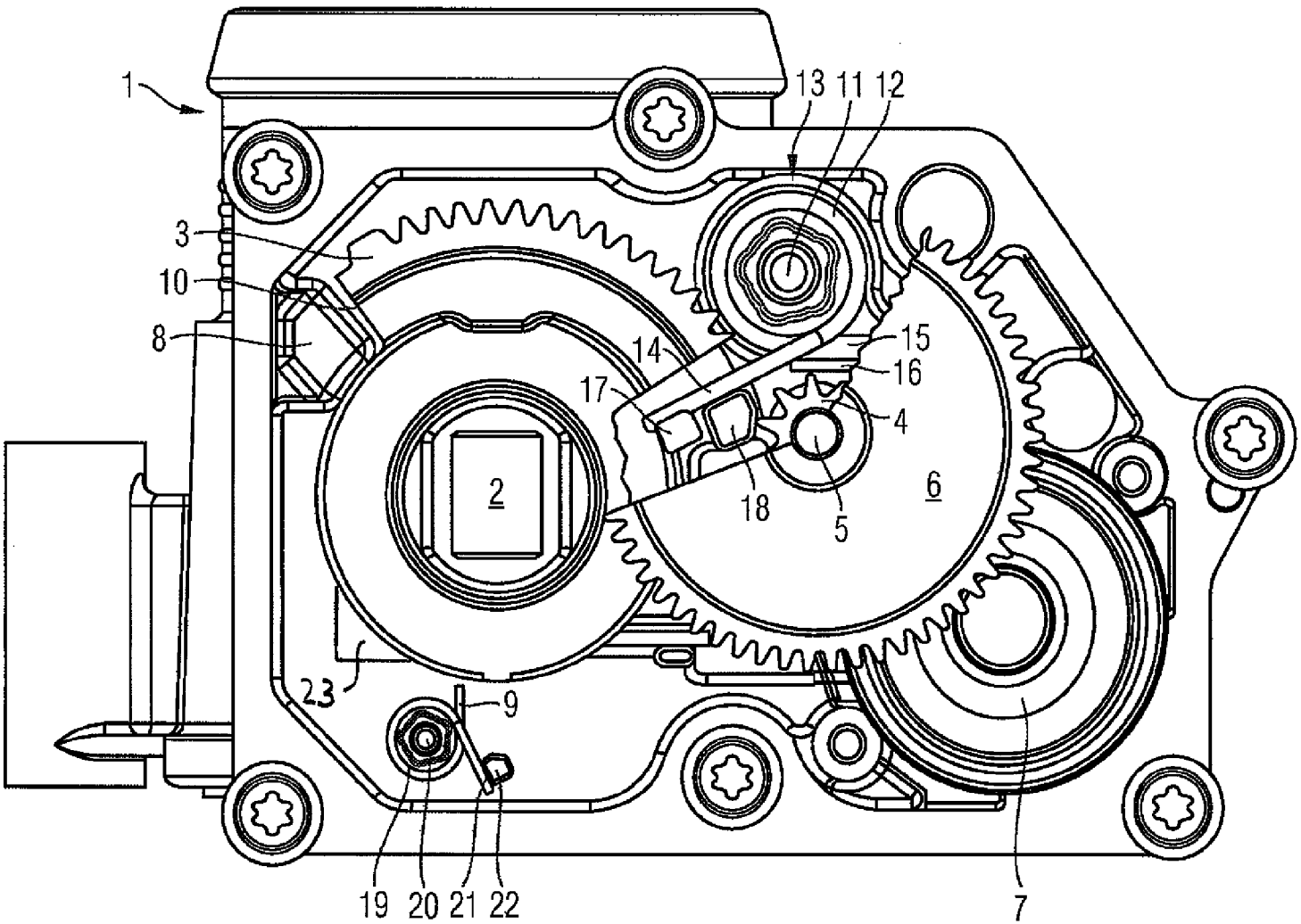
1
3
10
8
13
11
12
15
16
4
6
5
18
14
17
2
9
7
23
19
20
21
22

LOAD ADJUSTING DEVICE

PRIORITY CLAIM

This is a U.S. national stage of application No. PCT/EP2008/055603, filed on May 7, 2008, which claims Priority to the German, Application No.: 10 2007 025 441.7, filed: May 31, 2007, the content of both being incorporated herein by reference.

BACKGROUND OF THE INVENTION

1. Field of the Invention

The invention relates to a load adjusting device for an actuator embodied as a throttle valve arranged on an actuator shaft in a housing that determines a power output of an internal combustion engine, the actuator shaft being drivable so that by an actuating part rotationally fixed thereto and by a reversibly drivable actuating drive the throttle valve can pivot about the axis of rotation of the actuator shaft between a minimum load setting defined by a minimum load stop and a full load setting defined by a full load stop, and comprising a return spring acting on the actuating shaft in the minimum load direction.

2. Prior Art

In load adjusting devices of the prior art, both the return spring embodied as a torsion spring and the further torsion spring may be arranged coaxially with the axis of rotation of the actuator shaft.

This embodiment takes up a large overall space both axially and radially.

The assembly of the torsion springs is moreover both complicated and costly.

This also requires considerable effort when replacing one or both torsion springs.

SUMMARY OF THE INVENTION

An object of the invention is to create a load adjusting device of the aforesaid type that avoids these disadvantages, takes up little overall axial height, and is easy both to assemble and to dismantle.

According to one embodiment of the invention, this object is achieved in that the actuating part may be acted upon by a limb of a torsion spring which is fixedly located radially outside the pivoting range of the actuating part, the limb of the torsion spring extending into the pivoting range of the actuator.

This embodiment allows a construction of low overall height.

Since the arrangement of the torsion spring is situated outside the pivoting range of the actuating part, the torsion spring may be fitted pre-tensioned.

The torsion spring may be located anywhere around the pivoting range of the actuating part where it is easiest to fit and also at a considerable radial distance therefrom.

Since the torsion spring is preferably independent of the construction in the area of the actuator shaft and the actuating part, it may be of highly variable design in its shape, wire thickness, diameter etc.

The torsion spring preferably has one or more coils, the limb extends from the center of the one or more coils away outwards.

A simple insertion fitting is possible if the coils of the torsion spring enclose a dome fixed to the housing.

For easy, rotationally fixed arrangement the torsion spring may comprise a second limb extending away outwards from the center, which is simply braced against the housing to prevent rotation about the center of the torsion spring.

For this purpose the second limb is braced against one or more stops fixed to the housing.

An especially shallow configuration is achieved in that the limb or limbs of the torsion spring extend at least approximately in the plane of the pivoting range of the actuating part.

For the application of a force the actuating part may comprise a stop, which may serve to act upon the limb of the torsion spring.

This affords easy insertion fitting of the torsion spring.

For pivotally driving of the actuator the actuating part may be a toothed segment, in which a drive pinion rotatably driven by the actuating drive engages, and the drive pinion may be part of a transmission mechanism.

The actuating drive is preferably a reversible electric motor.

One possible way for the torsion spring to function is for the limb of the torsion spring to form the full load stop. This prevents a hard impact of the actuating part against the full load stop, thereby placing stresses on the components of the load adjusting device, so that it is possible to design the components with reduced stability, which leads to a reduction in overall size.

It is particularly advantageous here if the actuating part is a toothed segment, since the reduced tooth stress loading when the toothed segment strikes against the full load stop then substantially reduces the risk of tooth fracture.

A further possible way for the torsion spring to function is for the torsion spring to be an emergency running spring, which serves to move the actuating part from a position in the full load direction close to the minimum load setting up to an emergency running position of the actuator shaft.

This embodiment affords an easily assembled and dismantled arrangement of the emergency running spring.

If the actuating part comprises a moveable stop, to which the limb of the torsion spring applies a force between the position of the actuating part close to the minimum load setting and the emergency running position in the full load direction, the torsion spring can be installed through simple insertion fitting.

To limit the efficiency of the emergency running spring the pivotal mobility of the limb of the torsion spring in the full load direction is simply limited by an emergency running stop, fixed to the housing and defining the emergency running position.

The return spring may be a second torsion spring arranged coaxially with the axis of rotation of the actuator shaft.

BRIEF DESCRIPTION OF DRAWINGS

An exemplary embodiment of the invention is represented in the drawing and is described in more detail below.

FIG. 1 is a plan view of a load adjusting device.

DETAILED DESCRIPTION OF THE DRAWINGS

The load adjusting device represented in the FIG. 1 has a throttle valve assembly 1 forming a housing with a passage opening, in which a throttle valve (not shown) is fixedly arranged on an actuator shaft 2.

The actuator shaft 2 is pivotally supported in the throttle valve assembly 1 and carries a toothed segment 3, which is rotationally fixed on its end of rectangular cross section projecting from the passage opening and in which a drive pinion 4 engages.

The drive pinion 4 sits rotationally fixed on a rotatably supported transmission axis 5, on which a further rotatably fixed gear wheel 6 is also arranged, which can in turn be rotatably driven by an output pinion (not shown) of a reversible electric motor 7.

For greater clarity both the toothed segment 3 and the gear wheel 6 are partially cut away.

The toothed segment 3 is driven by an electric motor 7 so that it can pivot in both directions of rotation between a minimum load stop 8 and a full load embodied as a first limb 9 of a torsion spring, against which stops the toothed segment 3 comes to rest with its ends forming stop faces facing in a circumferential direction, of which the stop face 10 facing the minimum load stop 8 is shown.

In a counter-clockwise direction towards the minimum load stop 8 the toothed segment 3 is acted upon by a return spring 23, shown schematically.

Radially outside the pivoting range of the toothed segment 3 the throttle valve assembly 1 has a projecting dome or post 11, which is fixedly arranged parallel to the actuator shaft 2, an emergency running spring 13 embodied as a torsion spring and having a coil 12 enclosing or encircling said dome or post.

The emergency running spring 13 has a first limb 14 extending away outwards from its center and a second limb 15 extending away outwards in approximately the opposite direction to the first limb 14.

The second limb 15 is supported against a fixed stop 16, which prevents any rotation of the emergency running spring 13 in the clockwise direction.

Located on the toothed segment 3 at a radial distance from the axis of rotation of the actuator shaft 2 is a moveable stop 17, against which the free end area of the first limb 14 of the emergency running spring 13 comes to rest when the moveable stop 17 is situated in a range between the minimum load stop 8 and an emergency running stop 18 limiting the pivotal mobility of the first limb 14 in the full load direction. The emergency running stop 18 defines an emergency running position.

The force of the emergency running spring 13 acting on the toothed segment 3 in the full load direction is greater than the force of the return spring 23 acting on the toothed segment 3 in the minimum load direction.

In operation the toothed segment 3 is driven by the electric motor 7 in the minimum load direction until the stop face 10 bears against the minimum load stop 8. Once the moveable stop 17 has reached the first limb 14, the first limb 14 is in the process also displaced.

Should the electric motor 7 fail in the pivoting range in which the moveable stop 17 bears against the first limb 14, the first limb 14 moves the toothed segment 3 so far in the full load direction until the first limb 14 also comes to bear against the emergency running stop 18.

The throttle valve is thereby opened to a degree that ensures emergency running of the internal combustion engine.

When the toothed segment 3 is driven in the full load direction the toothed segment 3 pivots until it comes to bear with its second stop face (not shown) against the first limb 9 forming the full load stop and deflects the latter by a certain amount.

The torsion spring has a coil 19 with which it encloses a second fixedly arranged dome or post 20.

A second limb 21 of the torsion spring is supported against a fixed second stop 22, which prevents the torsion spring rotating in a counter-clockwise direction.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A load adjusting device comprising:

a housing;

a drive;

an actuator shaft arranged in the housing;

an actuating part rotationally fixed on the actuator shaft and configured to be driven by the drive to determine a power output of an internal combustion engine, the actuating part configured to pivot about an axis of rotation of the actuator shaft between a minimum load setting for the internal combustion engine defined by a minimum load stop and a full load setting for the internal combustion engine defined by a full load stop;

a return spring configured to act on the actuating shaft in a direction of the minimum load setting; and at least one torsion spring fixedly located radially outside a pivoting range of the actuating part, the torsion spring comprising a first limb extending into the pivoting range of the actuating part and configured to act on the actuating part and configured to move the actuating part to an emergency running position of the actuator shaft between the full load setting and the minimum load setting.

2. The load adjusting device as claimed in claim 1, wherein the at least one torsion spring further comprises at least one coil, the first limb extending outward from the at least one coil.

3. The load adjusting device as claimed in claim 2, wherein the at least one coil of the at least one torsion spring encircles a post fixed to the housing.

4. The load adjusting device as claimed in claim 2, wherein the at least one torsion spring further comprises a second limb extending away outwards from the at least one coil.

5. The load adjusting device as claimed in claim 4, wherein the second limb is braced against the housing to prevent rotation about a center of the at least one torsion spring.

6. The load adjusting device as claimed in claim 5, wherein the second limb is braced against one or more stops fixed to the housing.

7. The load adjusting device as claimed in claim 4, wherein at least one of the first and second limbs of the at least one torsion spring extend at least approximately in a plane of the pivoting range of the actuating part.

8. The load adjusting device as claimed in claim 1, wherein the actuating part comprises a stop configured to act upon the first limb of the at least one torsion spring.

9. The load adjusting device as claimed in claim 1, wherein the actuating part is a toothed segment configured to mate with a drive pinion, the dive pinion being rotatably driven by the drive.

10. The load adjusting device as claimed in claim 9, wherein the drive pinion is part of a transmission mechanism.

11. The load adjusting device as claimed in claim 1, wherein the drive is a reversible electric motor.

12. The load adjusting device as claimed in claim 1, wherein the first limb of the at least one torsion spring forms the full load stop.

13. The load adjusting device as claimed in claim 1, wherein the actuating part comprises a moveable stop to which the first limb of the at least one torsion spring applies a force between a position of the actuating part close to the minimum load setting and the emergency running position in the full load direction.

14. The load adjusting device as claimed in claim 13, wherein a pivotal mobility of a second limb of the at least one torsion spring in the full load direction is limited by an emergency running stop fixed to the housing, the emergency running stop defining the emergency running position.

15. The load adjusting device as claimed in claim 1, wherein the return spring is a second torsion spring arranged coaxially with the axis of rotation of the actuator shaft.

16. The load adjusting device as claimed in claim 1, wherein the load adjusting device a throttle valve.

* * * * *